US010844858B2

(12) United States Patent
Lee

(10) Patent No.: US 10,844,858 B2
(45) Date of Patent: Nov. 24, 2020

(54) LIQUID-RING VACUUM PUMP HAVING INTERNAL INSPECTION AND FOREIGN MATTER REMOVAL FUNCTIONS

(71) Applicant: Vaccomp Co., Ltd., Incheon (KR)

(72) Inventor: Seok Won Lee, Incheon (KR)

(73) Assignee: VACCOMP CO., LTD., Incheon (KR)

( * ) Notice: Subject to any disclaimer, the term of this patent is extended or adjusted under 35 U.S.C. 154(b) by 78 days.

(21) Appl. No.: 16/291,166

(22) Filed: Mar. 4, 2019

(65) Prior Publication Data

US 2020/0200172 A1 Jun. 25, 2020

(30) Foreign Application Priority Data

Dec. 24, 2018 (KR) ..... 10-2018-0168296

(51) Int. Cl.
*F04C 19/00* (2006.01)

(52) U.S. Cl.
CPC ..... *F04C 19/00* (2013.01); *F04C 19/001* (2013.01); *F04C 2230/91* (2013.01); *F04C 2240/30* (2013.01); *F04C 2240/80* (2013.01)

(58) Field of Classification Search
CPC .... F04C 19/00; F04C 19/001; F04C 2240/30; F04C 2240/80; F04C 2230/91
USPC ..... 417/68, 63; 418/2
See application file for complete search history.

(56) References Cited

U.S. PATENT DOCUMENTS 2,504,841 A * 4/1950 Jones ..... F04B 23/103 417/204
2,937,499 A * 5/1960 Klemt ..... F04C 19/002 123/234
2,939,399 A * 6/1960 Rutschi ..... F04D 13/0613 417/357
3,386,648 A * 6/1968 Rossem ..... F04C 18/3442 418/108
3,592,572 A * 7/1971 Schnell ..... F04C 13/002 418/169
4,465,442 A * 8/1984 Lang ..... F04C 15/0038 418/2
5,879,138 A * 3/1999 Arndt ..... F01C 21/08 417/244
6,082,972 A * 7/2000 Moore, Jr. ..... G01F 23/02 417/53

(Continued)

FOREIGN PATENT DOCUMENTS

KR 10-1803843 12/2017

*Primary Examiner* — Christopher S Bobish

(74) *Attorney, Agent, or Firm* — Lex IP Meister, PLLC

(57) ABSTRACT

Disclosed is a liquid-ring vacuum pump that enables a worker to inspect components provided in a main body from the outside using a see-through device without disassembling the main body and to easily remove foreign matter from the main body merely by demounting the see-through device from the main body. The liquid-ring vacuum pump includes a main body, which accommodates a shaft centrally mounted therein to receive rotational force from a driving motor and has a mounting hole formed therein so as to communicate with the interior of the main body, a rotor rotating together with the shaft inside the main body, a head unit coupled to at least one side of the main body, and a see-through device, which is detachably mounted in the mounting hole and includes a see-through window member to allow the interior of the main body to be inspected with the naked eye.

3 Claims, 7 Drawing Sheets

(56) References Cited

U.S. PATENT DOCUMENTS

| | | | | |
|---|---|---|---|---|
| 6,206,646 | B1 * | 3/2001 | Bucher | F04C 14/28 417/63 |
| 7,059,839 | B2 * | 6/2006 | Haller | F04C 29/02 417/410.3 |
| 7,083,393 | B2 * | 8/2006 | Myers | F01C 21/10 417/63 |
| 8,365,594 | B2 * | 2/2013 | Sabini | G01F 23/02 73/304 C |
| 2003/0175127 | A1 * | 9/2003 | Goodnick | F16C 17/10 417/63 |
| 2006/0147314 | A1 * | 7/2006 | Haller | F01C 21/10 417/63 |
| 2013/0243612 | A1 * | 9/2013 | Estes | F04D 29/00 417/53 |
| 2015/0050161 | A1 * | 2/2015 | Verdugo | F04B 49/03 417/46 |
| 2015/0128627 | A1 * | 5/2015 | Oda | F04D 25/0606 62/129 |
| 2020/0026061 | A1 * | 1/2020 | Huffman | F16L 41/008 |

* cited by examiner

[FIG. 1]
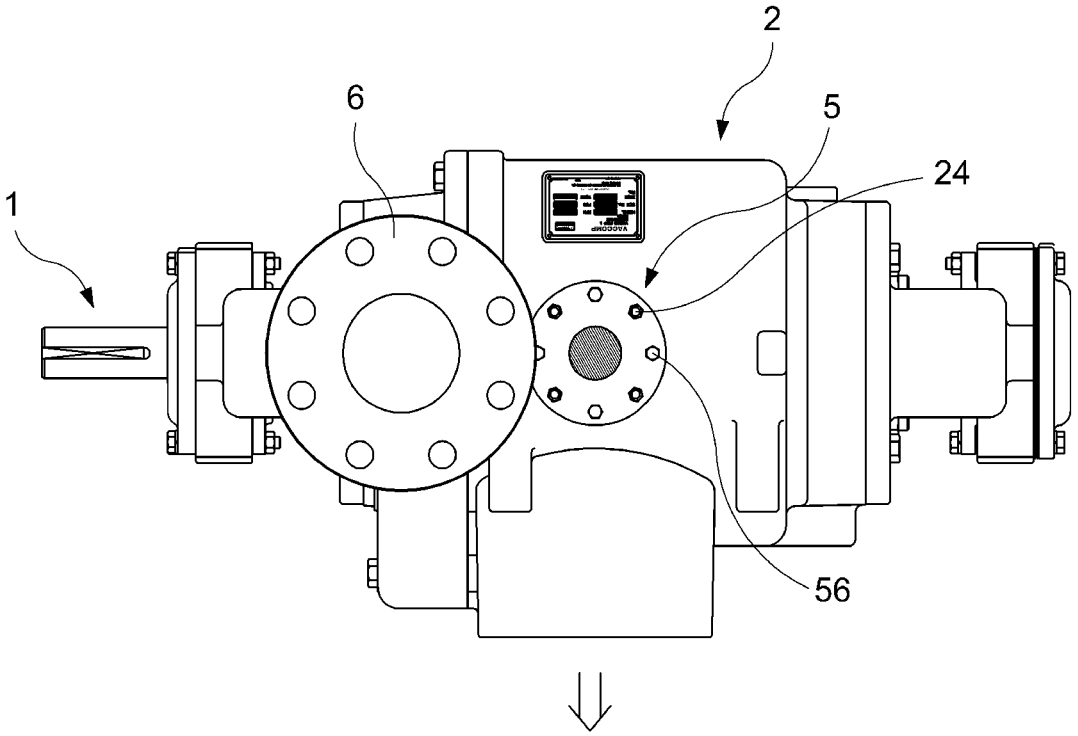
[FIG. 2]
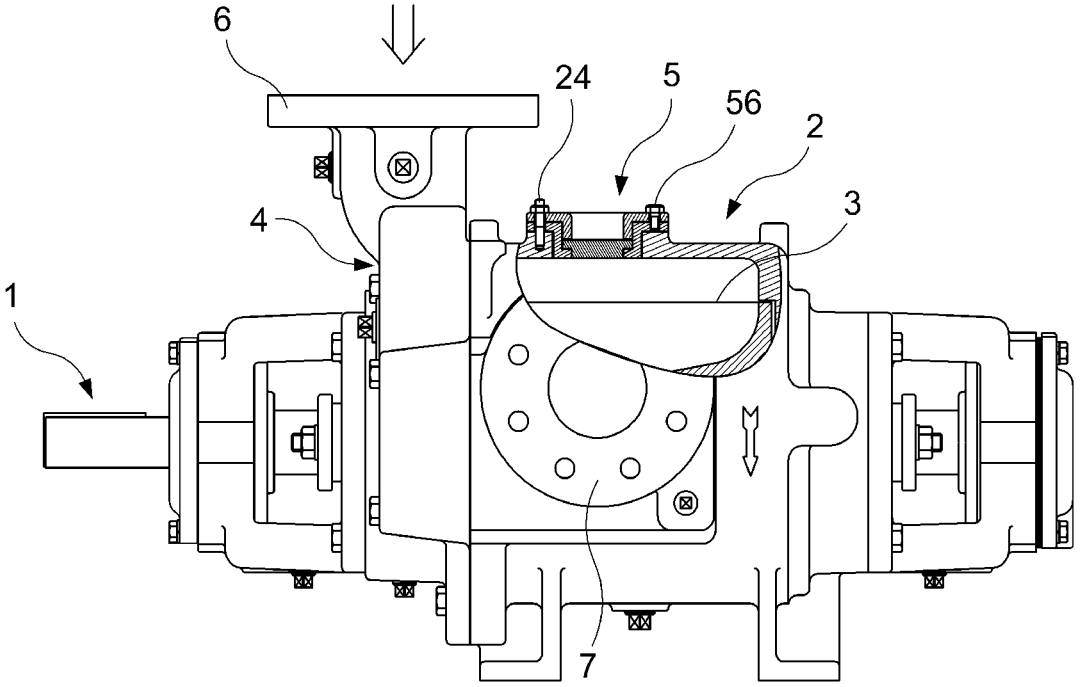

[FIG. 3]
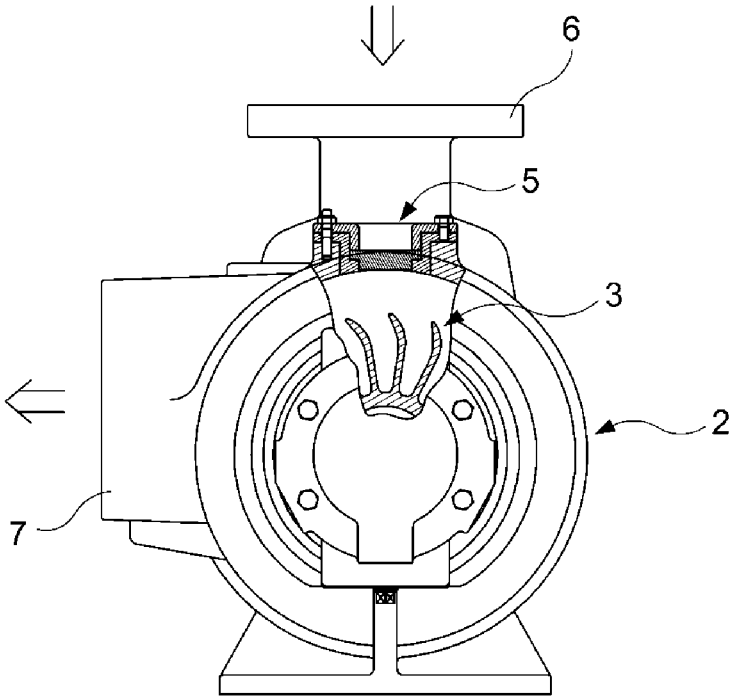

[FIG. 4]
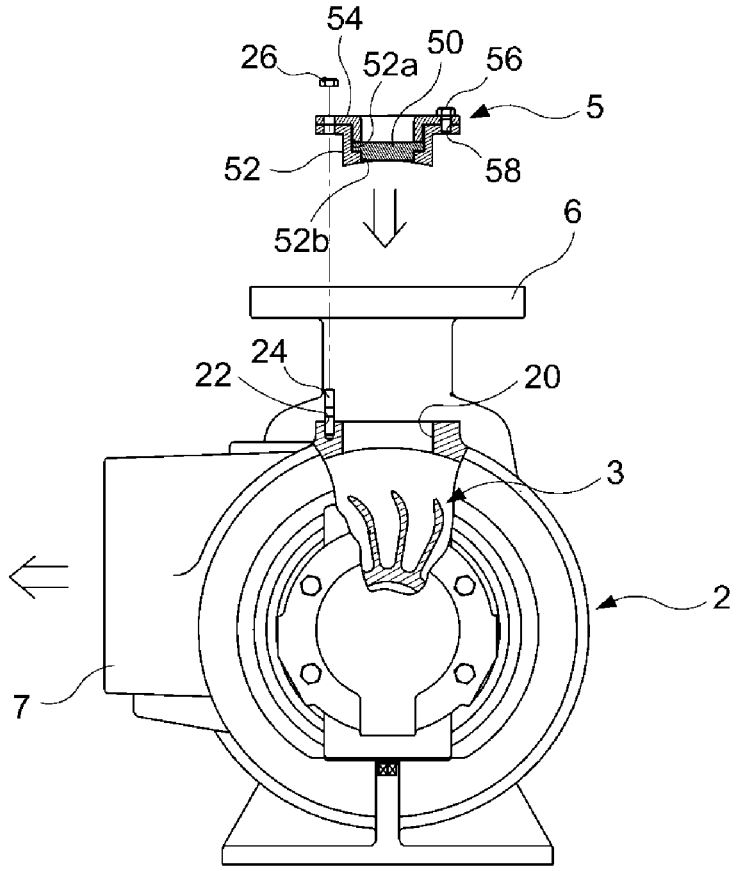

[FIG. 5]
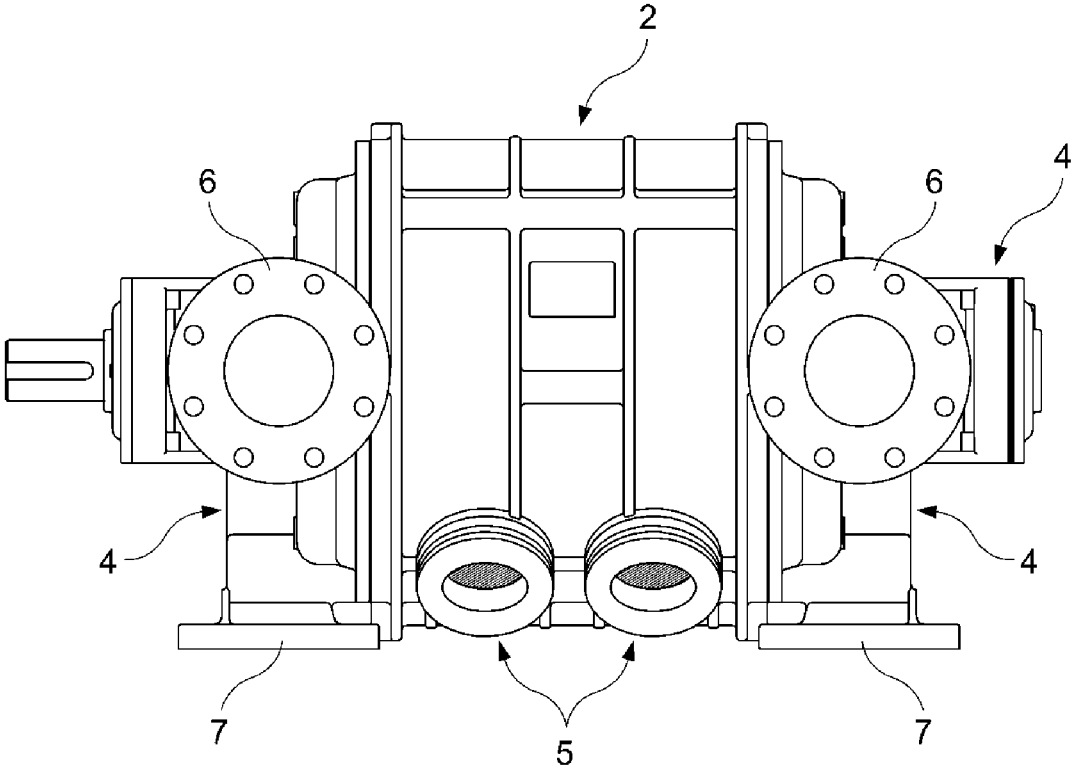

[FIG. 6]
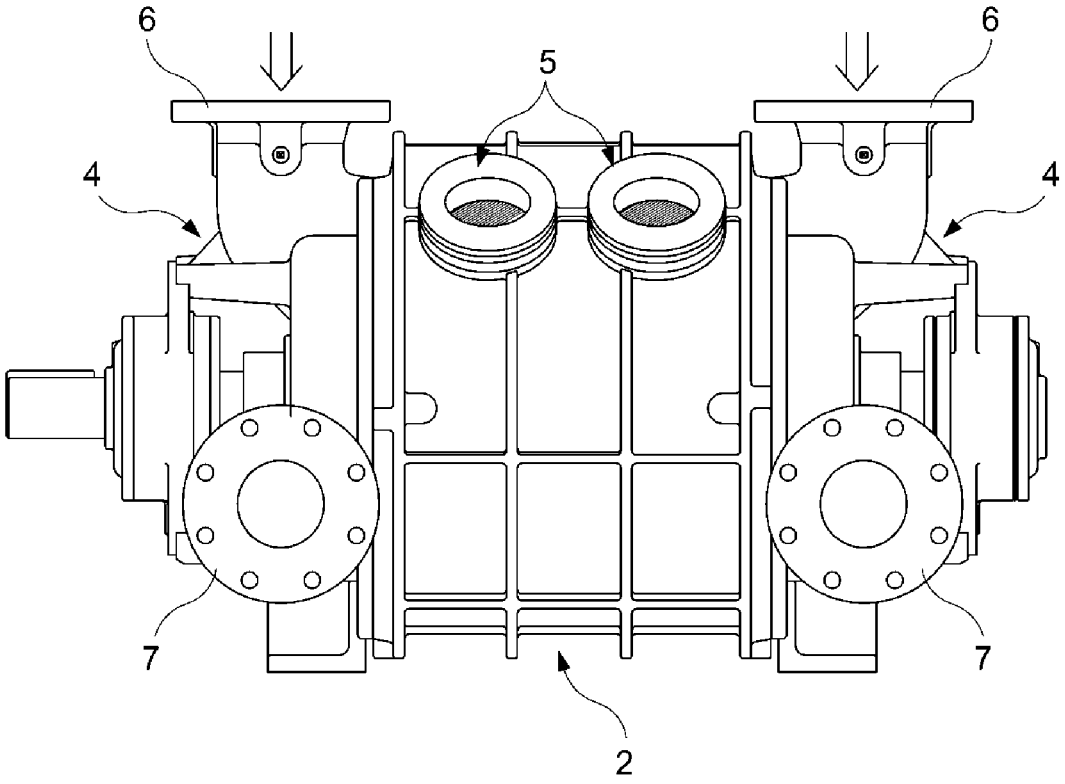
[FIG. 7]
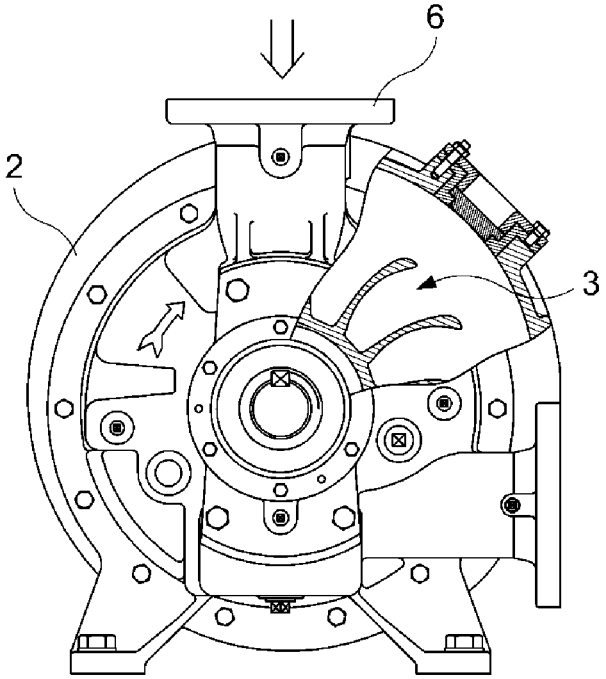

[FIG. 8]
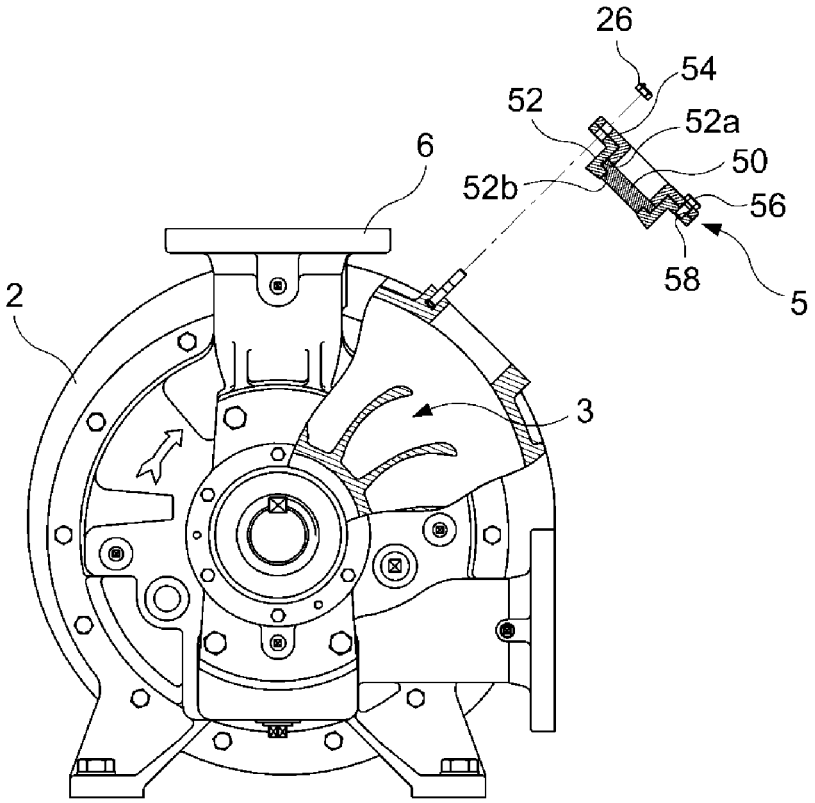

[FIG. 9]
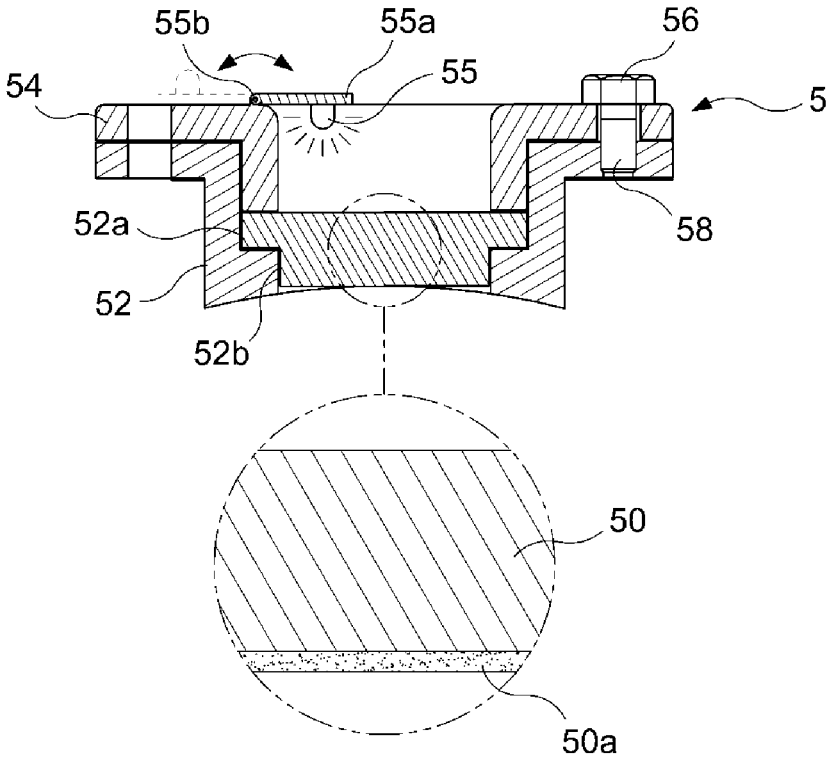

LIQUID-RING VACUUM PUMP HAVING INTERNAL INSPECTION AND FOREIGN MATTER REMOVAL FUNCTIONS

BACKGROUND OF THE INVENTION

Field of the Invention

The present invention relates to a liquid-ring vacuum pump, and more particularly to a liquid-ring vacuum pump having internal inspection and foreign matter removal functions, which enables a worker to inspect essential components provided in a main body from the outside using a see-through device, which is easily detachably mounted to a portion of the main body, without disassembling the main body, and to easily remove foreign matter accumulating in the main body during operation merely by demounting the see-through device from the main body.

Description of the Related Art

In general, a liquid-ring vacuum pump is a device in which an impeller is arranged eccentrically and the rotary motion of the impeller generates centrifugal force to cause the liquid charged therein to rotate, thereby compressing and feeding gas. A liquid-ring vacuum pump is commercially used as an intermediate vacuum pump or a low vacuum pump, which operates within a pressure range in the vicinity of atmospheric pressure, together with a vane pump, a Roots pump or the like.

As a conventional exemplary liquid-ring vacuum pump, technology related to a liquid-ring vacuum pump that facilitates replacement of internal components is disclosed in Korean Patent Registration No. 10-1803843, filed by the present applicant.

However, the conventional technology disclosed in the above related art document is not equipped with a device by which essential components provided in a main body can be confirmed with the naked eye from the outside. Thus, in order to inspect essential components provided in a main body, it is required to perform processes of disassembling the main body, drawing the essential components out of the main body, inspecting the essential components, removing foreign matter from the essential components, and assembling the essential components with the main body. This inspection process is time-consuming and incurs an increase in maintenance costs.

RELATED ART DOCUMENT

Patent Document (Patent Document 1) Korean Patent Registration No. 10-1803843 (issued on Dec. 4, 2017)

SUMMARY OF THE INVENTION

Therefore, the present invention has been made in view of the above problems, and it is an object of the present invention to provide a liquid-ring vacuum pump having internal inspection and foreign matter removal functions, which enables a worker to inspect essential components provided in a main body with the naked eye from the outside using a see-through device, which is easily detachably mounted to a portion of the main body, without disassembling the main body, and to easily remove foreign matter accumulating in the main body merely by demounting the see-through device from the main body without the necessity to disassemble the main body and by drawing the foreign matter out of the main body through a hole from which the see-through device has been demounted, thereby reducing the time and costs required for maintenance tasks including internal inspection, foreign matter removal, etc.

In accordance with the present invention, the above and other objects can be accomplished by the provision of a liquid-ring vacuum pump having internal inspection and foreign matter removal functions, the liquid-ring vacuum pump including a main body accommodating a shaft centrally mounted therein to receive rotational force from a driving motor, the main body including a mounting hole formed therein so as to communicate with the interior of the main body, a rotor configured to rotate together with the shaft inside the main body, a head unit coupled to at least one side of the main body, and a see-through device detachably mounted in the mounting hole, the see-through device including a see-through window member to allow the interior of the main body to be inspected with a naked eye.

The see-through device may include a lower cover member including a through-hole formed in the center thereof and a stepped portion formed around the through-hole. The see-through window member may be coupled to the stepped portion and the through-hole in the lower cover member in a fitting manner. The see-through device may further include an upper cover member coupled to an upper portion of the see-through window member and an upper portion of the lower cover member. The upper cover member and the lower cover member may be coupled to each other using a plurality of fixing bolts.

The main body may include a plurality of fastening holes formed around the mounting hole. Each of the fastening holes may be located at a position corresponding to a position between two adjacent ones of the fixing bolts fastened to the upper cover member and the lower cover member of the see-through device. The see-through device may include a plurality of bolt holes formed in the upper cover member and the lower cover member. Each of the bolt holes may be aligned with a corresponding one of the fastening holes, fastening bolts, having a greater length than the fixing bolts, may be fastened into the fastening holes via the bolt holes, and nuts may be threaded onto the fastening bolts.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a plan view of a small-sized vacuum pump, which illustrates an exemplary embodiment to which the function of the present invention is applied;

FIG. 2 is a partially cut-away front view of the embodiment shown in FIG. 1;

FIG. 3 is a partially cut-away side view of the embodiment shown in FIG. 1;

FIG. 4 is a side view illustrating the state in which a see-through device is demounted from the embodiment shown in FIG. 3;

FIG. 5 is a plan view of a large-sized vacuum pump, which illustrates another exemplary embodiment to which the function of the present invention is applied;

FIG. 6 is a front view of the embodiment shown in FIG. 5;

FIG. 7 is a partially cut-away side view of the embodiment shown in FIG. 5;

FIG. 8 is a side view illustrating the state in which a see-through device is demounted from the embodiment shown in FIG. 7; and FIG. 9 is a detailed cross-sectional view of a see-through device according to another embodiment of the present invention.

DETAILED DESCRIPTION OF THE INVENTION

Hereinafter, exemplary embodiments of the present invention will be described in detail with reference to the accompanying drawings.

First, as one embodiment of the present invention, the configuration of a small-sized liquid-ring vacuum pump (capacity: 10 $m^3$/Hr to 2,000 $m^3$/Hr) will be described with reference to FIGS. 1 to 4.

In this embodiment, the small-sized liquid-ring vacuum pump includes a main body 2, in which a shaft 1 configured to receive rotational force from a driving motor is centrally mounted, a rotor 3, which is configured to rotate together with the shaft 1 inside the main body 2, and a head unit 4, which is coupled to one side of the main body 2.

The main body 2 has a mounting hole 20 formed therein, which communicates with the interior of the main body 2. A see-through device 5, which includes a see-through window member 50, through which the interior of the main body 2 is inspected with the naked eye, is detachably mounted in the mounting hole 20.

The see-through device 5 includes a lower cover member 52, which has a through-hole 52*b* formed in the center thereof and a stepped portion 52*a* formed around the through-hole 52*b*, a see-through window member 50, which is coupled to the stepped portion 52*a* and the through-hole 52*b* in the lower cover member 52 in a fitting manner, and an upper cover member 54, which is tightly coupled to the upper portion of the see-through window member 50 and the upper portion of the lower cover member 52. The upper cover member 54 and the lower cover member 52 may be coupled to each other using a plurality of fixing bolts 56.

The see-through window member 50 is made from a transparent material such as, for example, a tempered glass material or synthetic resin.

In addition, the main body 2 has a plurality of fastening holes 22 formed around the mounting hole 20. Each of the fastening holes 22 is located at a position corresponding to a position between two adjacent ones of the fixing bolts 56 fastened to the upper and lower cover members 54 and 52 of the see-through device 5. After each of the bolt holes 58, which is located between two adjacent ones of the fixing bolts 56, is aligned with a corresponding one of the fastening holes 22, a fastening bolt 24, which is longer than the fixing bolt 56, is fastened into a corresponding fastening hole 22 via a corresponding bolt hole 58, and a nut 26 is threaded onto the fastening bolt 24.

Next, as another embodiment of the present invention, the configuration of a large-sized liquid-ring vacuum pump (capacity: 1,000 $m^3$/Hr to 30,000 $m^3$/Hr) will be described with reference to FIGS. 5 to 8. The large-sized liquid-ring vacuum pump includes a main body 2, in which a shaft 1 configured to receive rotational force from a driving motor is centrally mounted, a rotor 3, which is configured to rotate together with the shaft 1 inside the main body 2, and head units 4, which are coupled to both sides of the main body 2 so as to be symmetrical to each other.

The interior of the main body 2 is divided into two regions, and the rotor 3, which is mounted on the shaft 1, is provided in each of the two regions of the main body 2. The main body 2 has mounting holes 20 formed therein, each of which communicates with the interior of a corresponding one of the two regions of the main body 2. Each of see-through devices 5, which includes a see-through window member 50, through which the interior of a corresponding one of the two regions of the main body 2 is inspected with the naked eye, is detachably mounted in a corresponding one of the mounting holes 20. Since each of the see-through devices 5 and the mounting method thereof are the same as in the previously described embodiment, a detailed description thereof will be omitted.

Unexplained reference numeral 6 denotes a suction port, and 7 denotes a discharge port.

Hereinafter, the operational effects of the liquid-ring vacuum pump according to the present invention, configured as described above, will be described.

The see-through device 5 according to the present invention is configured such that the see-through window member 50 is coupled to the stepped portion 52*a* and the through-hole 52*b* in the lower cover member 52 in a fitting manner, such that the upper cover member 54 is tightly coupled to the upper portion of the see-through window member 50 and the upper portion of the lower cover member 52, and such that the upper cover member 54 and the lower cover member 52 are coupled to each other using a plurality of fixing bolts 56.

The see-through device 5 assembled in this manner is fitted in the mounting hole 20 formed in the main body 2. In the state in which each of the bolt holes 58 is aligned with a corresponding one of the fastening holes 22 formed around the mounting hole 20, the fastening bolt 24 is fastened into a corresponding fastening hole 22 via a corresponding bolt hole 58, and the nut 26 is threaded onto the fastening bolt 24. In this manner, the see-through device 5 is detachably mounted to the main body 2.

Thus, at normal times, it is possible to inspect essential components provided in the main body 2 through the see-through window member 50 of the see-through device 5, which is mounted to a portion of the main body 2 or a portion corresponding to a respective one of the two divided regions of the main body 2, whenever necessary, without disassembling the main body 2.

When foreign matter is found in the main body 2 during the inspection process, it possible to remove the foreign matter present in the main body 2 merely by demounting the see-through device 5 from the main body 2 and drawing the foreign matter out of the main body 2 through the mounting hole 20 without disassembling the main body 2. Further, it is also possible to perform other maintenance tasks through the mounting hole 20 without disassembling the main body 2.

After the maintenance is completed, the see-through device 5 is fitted in the mounting hole 20 and is secured to the main body 2 by fastening the fastening bolt 24 and the nut 26. Thereafter, the liquid-ring vacuum pump resumes operation.

As described above, since the see-through device 5 is easily detachably mounted to a portion of the main body 2 or a portion corresponding to a respective one of the two divided regions of the main body 2, it is possible to inspect essential components provided in the main body 2 with the naked eye from the outside without disassembling the main body 2. Further, when foreign matter is found in the main body 2, it is possible to remove the foreign matter to the outside from the interior of the main body 2 merely by demounting the see-through device 5 from the main body 2 without the necessity to disassemble the main body 2. As such, maintenance tasks, including internal inspection, foreign matter removal, etc., can be conveniently performed, leading to shortening of the maintenance time and reduction in maintenance costs.

FIG. 9 is a cross-sectional view illustrating the configuration of a see-through device according to another embodiment of the present invention. The see-through device includes a transparent coating layer 50*a*, which is coated on the inner surface of the see-through window member 50 in order to prevent internal foreign matter from adhering to the inner surface of the see-through window member 50. The transparent coating layer 50*a* has a composition including 30 to 50% by weight of epoxy resin, 10 to 30% by weight of paraffin wax, 10 to 30% by weight of fine silicon powder, 10 to20% by weight of urea resin, and 1 to 10% by weight of thermoplastic elastomer.

The transparent coating layer 50*a* having the above composition prevents contamination on the inner surface of the see-through window member 50, thereby facilitating internal inspection. In particular, the paraffin wax contained in the transparent coating layer 50*a* improves the lubrication function of the coating layer, the fine silicon powder enhances the durability of the coating layer to prevent cracking, and the urea resin prevents agglomeration of the silicon powder to thus maintain a constant thickness of the coating layer. Further, the addition of thermoplastic elastomer prevents the coating layer from being deformed by the internal pressure in the pump.

In addition, the see-through device 5 further includes a light-emitting lamp 55, which is externally mounted to the see-through device 5 in order to facilitate internal inspection, and a reflecting plate 55*a*, which is made of a light-reflective material and is disposed on the rear side of the light-emitting lamp 55 in order to minimize optical loss.

In particular, the reflecting plate 55*a* is pivotably hinged to the see-through device 5 via a hinge pin 55*b*. At normal times, the reflecting plate 55*a* is located such that the light-emitting lamp 55 is oriented in an outward direction. When the interior of the main body 2 needs to be illuminated, the reflecting plate 55*a* is pivoted about the hinge pin 55*b* so that the light-emitting lamp 55 is oriented toward the interior of the main body 2 to illuminate the same. The light-emitting lamp 55 is configured to be turned ON and OFF using a separate switch (not illustrated). In order to receive electric power, the light-emitting lamp 55 may be connected with an external power source via a separate cable, or may be connected with an internal power source mounted in the see-through device 5.

With this configuration of the see-through device 5, when the interior of the main body 2 needs to be illuminated, the reflecting plate 55*a* is pivoted about the hinge pin 55*b* so that the light-emitting lamp 55 is oriented toward the interior of the main body 2, and the light-emitting lamp 55 is turned ON to emit light. The light emitted from the light-emitting lamp 55 illuminates the interior of the main body 2. Further, optical loss is minimized by the reflecting plate 55*a*. Accordingly, a worker is capable of more clearly inspecting the operational state or the contamination state of the components in the main body of the pump from the outside.

As is apparent from the above description, according to the present invention, a worker is capable of inspecting essential components provided in the main body with the naked eye from the outside using the see-through device, which is easily detachably mounted to a portion of the main body, without disassembling the main body, and is capable of easily removing foreign matter accumulating in the main body merely by demounting the see-through device from the main body without the necessity to disassemble the main body and by drawing the foreign matter out of the main body through a hole from which the see-through device has been demounted, thereby conveniently performing maintenance tasks including internal inspection, foreign matter removal, etc., and reducing the time and costs required for the maintenance tasks.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A liquid-ring vacuum pump comprising:

a main body accommodating a shaft centrally mounted therein to receive rotational force from a driving motor, the main body comprising a mounting hole formed therein, the mounting hole communicating with an interior of the main body;

a rotor configured to rotate together with the shaft inside the main body;

a head unit coupled to at least one side of the main body; and a see-through device detachably mounted in the mounting hole, the see-through device comprising a see-through window member to allow the interior of the main body to be inspected with a naked eye, wherein the see-through device comprises:

a lower cover member including a through-hole formed in a center thereof and a stepped portion formed around the through-hole, wherein the see-through window member is coupled to the stepped portion and the through-hole in the lower cover member in a fitting manner; and an upper cover member coupled to an upper portion of the see-through window member and an upper portion of the lower cover member, wherein the upper cover member and the lower cover member are coupled to each other using a plurality of fixing bolts, wherein the main body comprises a plurality of fastening holes formed around the mounting hole, each of the fastening holes being located at a position corresponding to a position between two adjacent ones of the fixing bolts fastened to the upper cover member and the lower cover member of the see-through device, wherein the see-through device comprises a plurality of bolt holes formed in the upper cover member and the lower cover member, and wherein each of the bolt holes is aligned with a corresponding one of the fastening holes, fastening bolts, having a greater length than the fixing bolts, are fastened into the fastening holes via the bolt holes, and nuts are threaded onto the fastening bolts.

2. The liquid-ring vacuum pump according to claim 1, wherein the interior of the main body is divided into two regions, wherein the mounting hole comprises first and a second mounting holes, each being located to communicate with an interior of a corresponding one of the two regions of the main body, and wherein the see-through device comprises first and a second see-through devices detachably mounted in the first and second mounting holes respectively, each of the first and second see-through devices comprises the see-through window member allowing the interior of the main body to be inspected with a naked eye.

3. A liquid-ring vacuum pump comprising:

a main body accommodating a shaft centrally mounted therein to receive rotational force from a driving motor, the main body comprising a mounting hole formed therein, the mounting hole communicating with an interior of the main body;

a rotor configured to rotate together with the shaft inside the main body;

a head unit coupled to at least one side of the main body; and a see-through device detachably mounted in the mounting hole, the see-through device comprising a see-through window member to allow the interior of the main body to be inspected with a naked eye, wherein the see-through device further comprises:

a transparent coating layer coated on an inner surface of the see-through window member to prevent foreign matter from adhering to the inner surface of the see-through window member, the transparent coating layer having a composition comprising epoxy resin, paraffin wax, fine silicon powder, urea resin, and thermoplastic elastomer;

a light-emitting lamp configured to illuminate the interior of the main body; and a reflecting plate disposed on a rear side of the light-emitting lamp, the reflecting plate being pivotably hinged to the see-through device via a hinge pin.

* * * * *